US007106258B2

(12) United States Patent
Kuramoto

(10) Patent No.: US 7,106,258 B2
(45) Date of Patent: Sep. 12, 2006

(54) FLAT WIDEBAND ANTENNA

(75) Inventor: Akio Kuramoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 11/017,738

(22) Filed: Dec. 22, 2004

(65) Prior Publication Data

US 2005/0140553 A1 Jun. 30, 2005

(30) Foreign Application Priority Data

Dec. 26, 2003 (JP) ..... 2003-432993

(51) Int. Cl.
*H01Q 1/38* (2006.01)

(52) U.S. Cl. ..... 343/700 MS; 343/795

(58) Field of Classification Search ..... 343/700 MS, 343/793, 795, 810
See application file for complete search history.

(56) References Cited

U.S. PATENT DOCUMENTS

| | | | | |
|---|---|---|---|---|
| 6,337,666 | B1 | 1/2002 | Bishop | |
| 6,339,404 | B1 | 1/2002 | Johnson et al. | |
| 6,339,405 | B1 * | 1/2002 | Gleener | 343/795 |
| 6,417,816 | B1 * | 7/2002 | Sadler et al. | 343/795 |
| 6,476,769 | B1 | 11/2002 | Lehtola | |
| 6,538,614 | B1 * | 3/2003 | Fleming et al. | 343/767 |
| 6,765,539 | B1 * | 7/2004 | Wang et al. | 343/795 |
| 6,906,678 | B1 * | 6/2005 | Chen | 343/795 |
| 2003/0098812 | A1 | 5/2003 | Ying et al. | |
| 2004/0056805 | A1 | 3/2004 | Chen | |

FOREIGN PATENT DOCUMENTS

| | | |
|---|---|---|
| EP | 02079602 | 2/1990 |
| TW | 560107 B | 1/2003 |

OTHER PUBLICATIONS

Antenna Engineering Handbook, edited by Electronics, Information and Communication Engineers, published by Ohm Co., Sep. 30, 1991, pp. 128-129.

* cited by examiner

*Primary Examiner*—Shih-Chao Chen
(74) *Attorney, Agent, or Firm*—Foley & Lardner LLP

(57) ABSTRACT

In an antenna, a first flat radiating element is placed longitudinally. A second flat radiating element is located opposite to the first flat radiating element. The first and the second radiating element are connected to each other at their lower end portions. A third flat radiating element is longitudinally located below the second flat radiating element. A central conductor of a coaxial cable is connected to the lower end portions of the first and the second flat radiating elements. An outer conductor of the coaxial cable is connected to an upper end portion of the third flat radiating element. The coaxial cable is located parallel to the third flat radiating element.

13 Claims, 11 Drawing Sheets

FLAT WIDEBAND ANTENNA

This application claims priority to prior application JP 2003-432993, the disclosure of which is incorporated herein by reference.

BACKGROUND OF THE INVENTION

This invention relates to an antenna, in particular, to an antenna built in an electronic apparatus, such as a personal computer, a printer, a copying machine, an audio-visual apparatus or the like.

Recently, a wireless local area network (LAN) system has come to be used in various places such as an (large scale) office, a hot spot service area, a school, a firm, a home and so on. Then, there is a demand to connect not only computers but also various electronic apparatus such as a copy machine, a projector, a printer, audio-visuals including a television set and/or a video recorder, or the like, to the wireless LAN system. To achieve this, a technique referred to as UWB (Ultra Wideband) has been proposed. The UWB can transmit large size data such as extended definition (moving) picture data at a high speed (e.g. 480 Mbps in maximum).

For the UWB, a frequency range from 3.1 to 10.6 GHz is supposed to be used as of December 2003. Accordingly, an antenna functioning over a very wide or broad band is necessary for the UWB. Furthermore, the antenna must have a small size to be built in the electronic apparatus as mentioned above. In addition, it is desirable that the antenna has a shape like a two-dimensional shape rather than a three-dimensional shape. This is because it is easy to be built in the electronic apparatus.

However, no antenna meets the above mentioned conditions at the present time.

A discone antenna is one of well-known antennas functioning over the wide band. Such an antenna is disclosed in "ANTENNA ENGINEERING HANDBOOK" (at page 128 of the sixth impression of the first edition) edited by IEICE (Institute of Electronics, Information and Communication Engineers) and published by Ohm Co. on Sep. 30, 1991.

Though the discone antenna functions over the wide band, it has the three-dimensional shape and is hard to be built in the personal computer, the audio-visual apparatus, or the like.

SUMMARY OF THE INVENTION

It is therefore an object of this invention to provide an antenna having an ultra wide band performance and a shape suitable for being built in an electronic apparatus.

Other objects of this invention will become clear as the description proceeds.

According to an aspect of this invention, an antenna comprises a first flat radiating element extended from a predetermined portion toward a first side. A second flat radiating element is extended to the predetermined portion toward the first side substantially parallel with the first flat radiating element. A third flat radiating element is extended from the predetermined portion toward a second side opposite to the first side. A first feeding line is electrically connected to both the first flat radiating element and the second flat radiating element at the predetermined portion. A second feeding line is located close to the first feeding line and electrically connected to the third flat radiating element at the predetermined portion. The first through the third flat radiating elements are faced to the same direction.

In the antenna, the second flat radiating element has a ring-like shape to define an opening.

DESCRIPTION OF THE PREFERRED EMBODIMENTS

Figure 1:
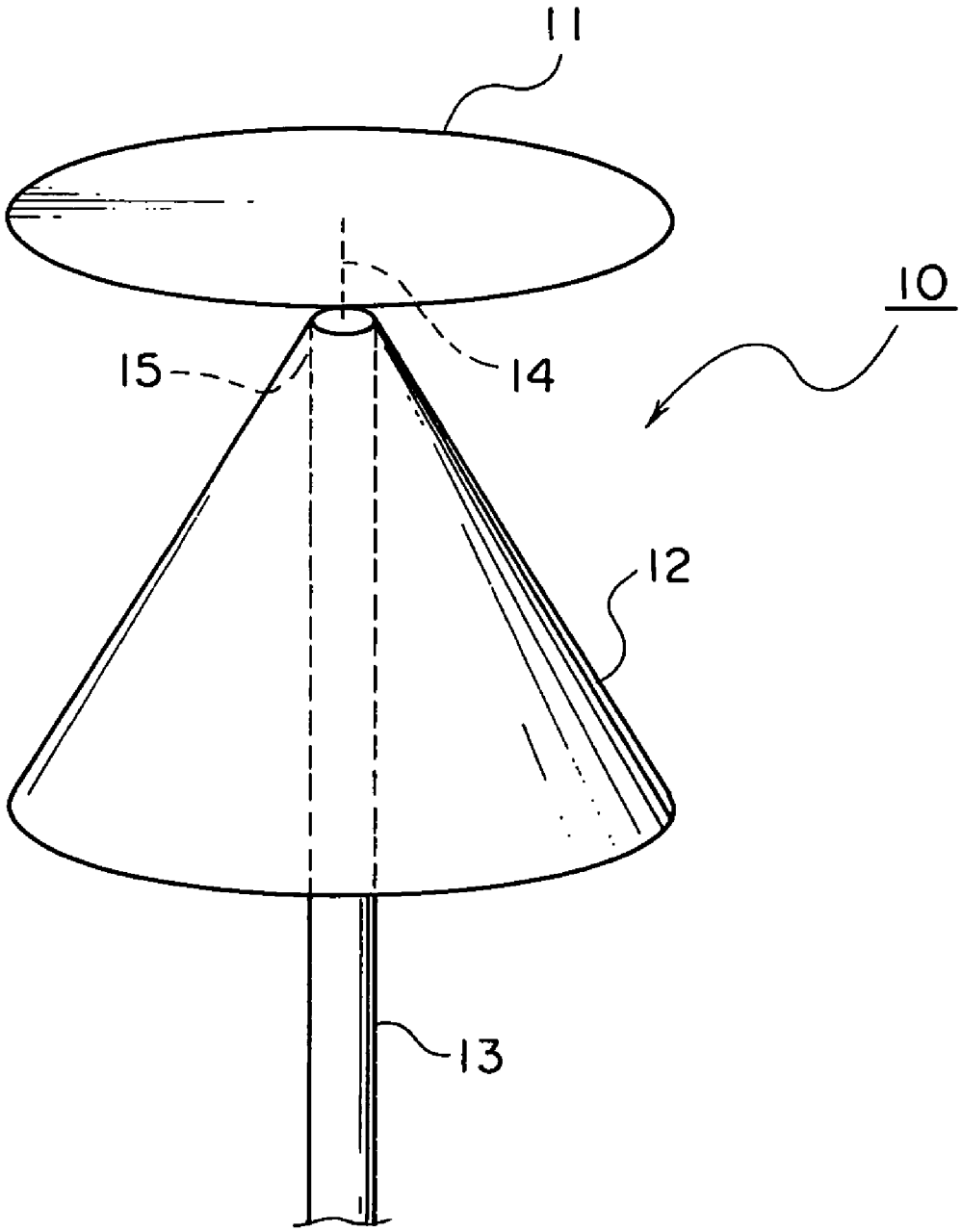
FIG. 1 PRIOR ART
FIG. 1 is an oblique perspective view of an example of an existing discone antenna.

Referring to FIG. 1, description will be at first directed to an existing discone antenna having omnidirectional radiation characteristic (or a circular radiation pattern) in azimuth and functioning over a wide band (e.g. 7–10 times as high as a lowest usable frequency).

The discone antenna is well known as an omnidirectional wideband antenna. As illustrated in FIG. 1, the discone antenna 10 includes a disc conductor 11, a conic conductor 12, and a coaxial cable 13. The coaxial cable 13 has a central conductor 14 and an outer conductor 15. The central conductor 14 is connected to a center of the disc conductor 11. The outer conductor 15 is connected to an upper end portion of the conic conductor 12. Feeding of the discone antenna 10 is executed through the coaxial cable 13.

However, the discone antenna 10 is unsuitable to be built in an electronic apparatus such as a personal computer, an audio-visual apparatus or the like because it has a three-dimensional shape as shown in FIG. 1.

Figure 2:
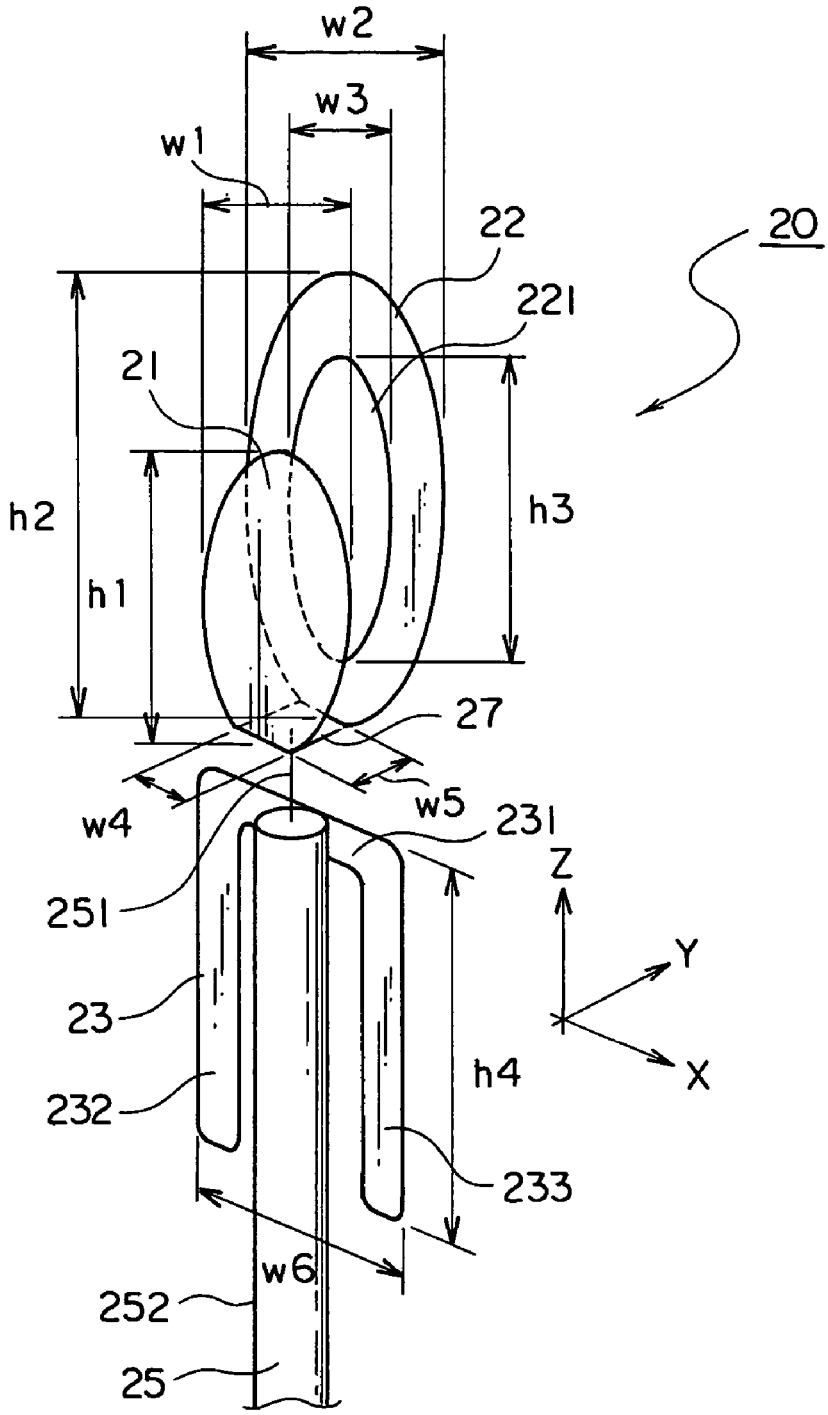
FIG. 2 is an oblique perspective view of an antenna according to a first embodiment of this invention.

Referring to FIG. 2, the description will proceed to an antenna according to a first embodiment of this invention.

In FIG. 2, the antenna 20 includes a first flat radiating element 21, a second flat radiating element 22, a third flat radiating element 23, and a coaxial cable 25. The first to third flat radiating elements 20, 21 and 22 are faced to the same direction and connected to the coaxial cable 25 at a feeding portion between the first or second flat radiating element 20 or 21 and the third radiating element 22. The first and the second flat radiating elements 21 and 22 are extended to upper side from the feeding portion while the third flat radiating element 23 is extended to lower side from the feeding portion.

The first flat radiating element 21 has an outer shape of an ellipse or oval, a main surface and a major axis. Hereinafter, it is assumed that the first flat radiating element 21 is located so that the main surface is perpendicular to a Y-axis and that the major axis is in parallel to a Z-axis. Additionally, it is desirable that the first flat radiating element 21 is placed vertically. Accordingly, it is possible to regard the Z-axis as a vertical axis.

The second flat radiating element 22 has an elongated annular (or ring-like) shape with outer and inner shapes similar to the outer shape of the first flat radiating element 21. The inner shape of the second flat radiating element 22 defines an opening (or a punched portion) 221. The outer shape of the second flat radiating element 22 may be incompletely similar to the outer shape of the first flat radiating element 21. Moreover, the outer and the inner shapes of the second flat radiating element 22 may have some difference between them. For instance, the outer and the inner shapes of the second flat radiating element 22 may be formed so that the second flat radiating element 22 has a constant radial width. Furthermore, the outer and the inner shapes may have individual centers. For example, the opening 221 may be formed at one side on a major axis (of the outer shape) of the second flat radiating element 22.

The second flat radiating element 22 is opposite to the first flat radiating element 21 with leaving a space between them so that the major axis thereof is substantially parallel to the Z-axis. In other words, a main surface and the major axis of the second flat radiating element 22 is substantially parallel to those of the first flat radiating element 21.

Furthermore, the second flat radiating element 22 has a lower end portion level with a lower end portion of the fist flat radiating element 21. The lower end portions of the first and the second flat radiating elements 21 and 22 are connected to each other with a conductive piece 27.

The third flat radiating element 23 has a U or horseshoe shape with a crossbar portion 231 and a pair of arm portions 232, 233 extending from both ends of the crossbar portion 231. The crossbar portion 231 and the arm portions 232, 233 may have a common width. Alternatively, the crossbar portion 231 may be different from the arm portions 232 and 233 in width.

The third flat radiating element 23 is arranged at a lower side of the second radiating element 22 so that a main surface thereof is substantially perpendicular to the Y-axis. The crossbar portion is placed at a distance from the lower end portions of the first and the second flat radiating elements 21 and 22. A central axis of the third flat radiating element 23 is substantially parallel to the Z-axis. The central axis of the third radiating element 23 may be collinear with the major axis of the second radiating element 22. The arm portions 232, 233 are oriented downwards (or in an inverse Z-axis direction). In other words, the arm portions 232, 233 substantially extend to the opposite side of the first and the second radiating elements 21 and 22 along the Z-axis.

A coaxial cable 25 has a central conductor 251 and an outer conductor 252 as feeding lines. The coaxial cable 25 is substantially located parallel to the Z-axis. The central conductor 251 is electrically connected to the first and the second flat radiating elements 21 and 22 through the conductor piece 27. On the other hand, the outer conductor 252 has an end portion level with an edge of the crossbar portion 231. The outer conductor 252 is fixed and electrically connected to the middle of the crossbar portion 231. The whole or a part of the width of the crossbar portion 231 may be fixed to the outer conductor 252. The coaxial cable 25 has a length longer than a height h4 of the third flat radiating element 23. The coaxial cable 25 may be bent at a point farther than the ends of the arm portions 232, 233 from the crossbar portion 231. Alternatively, the coaxial cable 25 may be bent just under the crossbar portion 231.

The first to the third flat radiating elements 21–23 and the conductive piece 27 may be formed by cutting one or more conductive (thin) plates. In particular, the first and the second flat radiating elements 21, 22 and the conductive piece 27 may be formed as a continuous plate cut from one conductive plate. In such a case, bending the continuous plate forms the first and the second flat radiating elements 21, 22 and the conductive piece 23. As the conductive plate for the first through the third flat radiating elements 21–23, there is a copper plate, a brass plate, an aluminum plate or the like. The conductive plate may have a thickness of 0.1–2 mm, for example. In addition, the conductive plate may be plated or coated to prevent from rusting.

In an example, the first flat radiating element 21 has a height h1 equal to about 0.16 times as large as a wavelength λL corresponding to a lowest usable frequency fL. Furthermore, the first flat radiating element 21 has a width w1 equal to about 0.1 times as large as the wavelength λL or less. A height h2 and a width w2 of the second flat radiating element 22 are equal to about 0.25 times and about 0.16 times as large as the wavelength λL. Moreover, a height h3 and a width w3 of the opening 221 of the second flat radiating element 22 is equal to about 0.13 times and about 0.06 times as large as the wavelength λL. In addition, a width w4 and a length w5 of the conductive piece 27 have values between a hundredths part and a twentieth part of the wavelength λL. Regarding the third flat radiating element 23, the height h4 and a width w6 each are equal to about 0.2–0.25 times as large as the wavelength λL. According to this example, the antenna can function over a range from the usable lowest frequency fL to about 5 times as high as the usable lowest frequency fL or more. In addition, the antenna is easy to be built in an apparatus because it is small in size and thickness. Moreover, the antenna is inexpensive because it has a simple structure and is easy to be manufactured.

Figure 3:
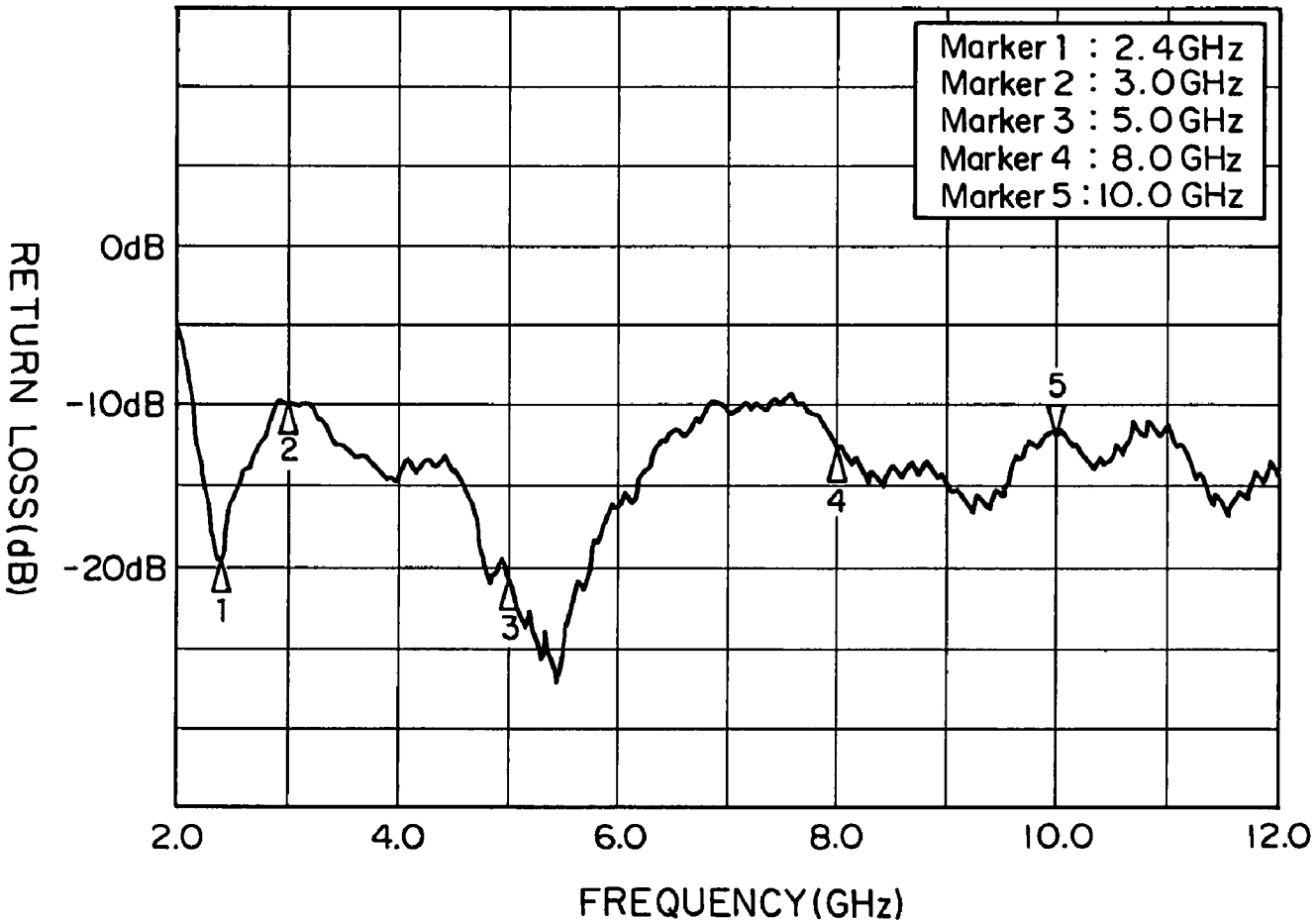
FIG. 3 is a graph of a return loss characteristic of the antenna of FIG. 2.

FIG. 3 is a graph of return losses of the antenna 20 against frequencies. Here, the antenna 20 has measures as follows for the usable lowest frequency fL of 2.4 GHz. The wavelength λL corresponding to the usable lowest frequency fL is equal to 125 mm.

The first flat radiating element 21 has the height h1 of 20 mm and the width w1 of 10 mm. The height h1 and the width w1 are corresponding to 0.16 times and 0.08 times as large as the wavelength λL. The second flat radiating element 22 has the height h2 of 30 mm, the width w2 of 20 mm, the height h3 of 16 mm, and the width w3 of 8 mm. The height h2, the width w2, the height h3 and the width w3 are corresponding to 0.24 times, 0.16 times, about 0.13 times, and about 0.08 times as large as the wavelength λL, respectively. The conductive piece 27 has the width w4 and the length w5 which are equal to 3 mm and 2.5 mm. The width w4 and the length w5 are corresponding to about fortieth and fiftieth of the wavelength λL. The third flat radiating element 23 has the height h4 of 27 mm and the width w6 of 27 mm. The height h4 and the width w6 are corresponding to 0.22 times as large as the wavelength λL.

As shown in FIG. 3, the antenna 20 has the return losses under −9.5 dB over frequency range from 2.4 to 10.6 GHz. That is, the antenna 20 can operates over not only a frequency range (3.1–10.6 GHz) for UWB but also a frequency range (of 2.4 GHz) for wireless LAN. Accordingly, the antenna 20 is suitable for the personal computer and the (household) audio-visual apparatus. In addition, the antenna 20 has VSWR (Voltage Standing Wave Ratio) of 2.0 or less.

Figure 4:
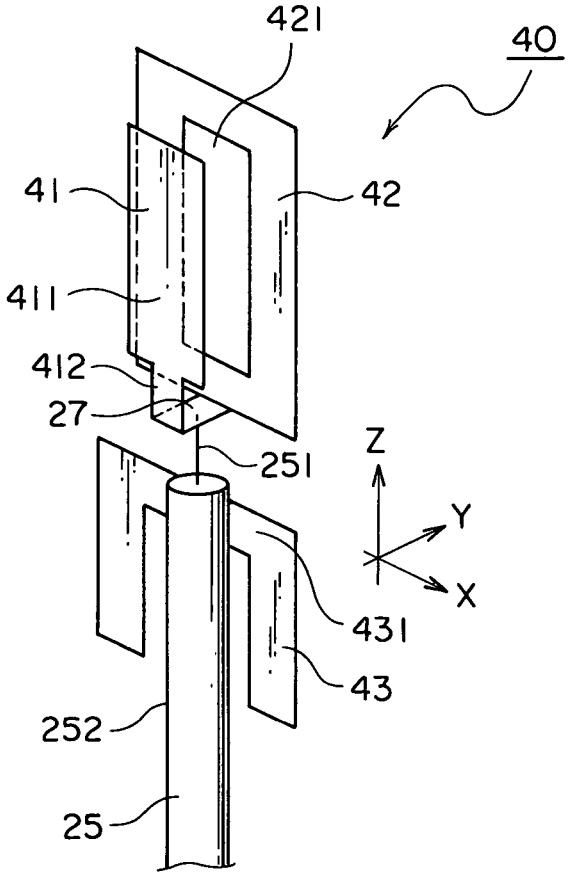
FIG. 4 is an oblique perspective view of an antenna according to a second embodiment of this invention.

Referring to FIG. 4, the description will be made about an antenna according to a second embodiment of this invention. Similar parts are designated by similar reference numerals.

In FIG. 4, the antenna 40 is similar to the antenna 20 of FIG. 2 except that first to third flat elements 41–43 have angular or squared corners.

In detail, the first flat radiating element 41 has a main rectangular portion 411 and a rectangular tab portion 412 extending from a lower end of the main portion 411 downward. A lower end portion of the tab portion 412 is coupled to the end portion of the second radiating element 42 with the conductive piece 27.

The second flat radiating element 42 has an angular ring (or frame) shape with outer and inner shapes. The outer and inner shapes are similar to the shape of the main portion 411 of the first flat radiating element 41. The outer shape of the second flat radiating element 42 may be incompletely similar to the shape of the first flat radiating element 41. The outer and the inner shapes of the second radiating element 42 may have some difference between them. For instance, the outer and the inner shapes of the second flat radiating element 42 may be formed so that vertical and horizontal portions of the second flat radiating element 42 have a common width. Furthermore, An opening 421 may be formed at one side on a longitudinal axis of the second radiating element 42. An opening 421 is equal to or smaller than the first flat radiating element 41.

The central conductor 251 of the coaxial cable 25 is connected to the conductive piece 27 to be electrically connected to the first and the second flat radiating elements 41 and 42. The outer conductor 252 is connected to the middle of a crossbar portion 431 of the third flat radiating element 43. Though an upper edge of the crossbar portion 431 is lower than the end of the outer conductor 252, they may be arranged in the same level.

The first to the third flat radiating elements 4143 and the conductive piece 27 may be formed like the case of the antenna 20 of FIG. 2. The first to the third flat radiating elements 31–33 and the conductive piece 27 have measurements which are almost the same as those of the antenna 20 of FIG. 2. Strictly, the measurements of the first to the third flat radiating elements 31–33 and the conductive piece 27 are dependent on their shapes.

Figure 5:
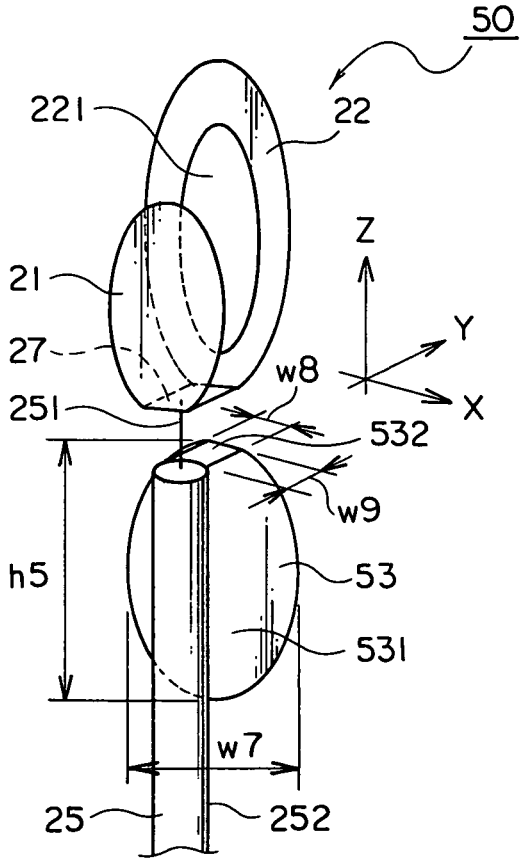
FIG. 5 is an oblique perspective view of an antenna according to a third embodiment of this invention.

Referring to FIG. 5, the description will be made about an antenna according to a third embodiment of this invention.

In FIG. 5, the antenna 50 is similar to the antenna 20 of FIG. 2 except that a third flat radiating element 53 has a main portion 531 of an elliptic or oval shape and a rectangular tab portion 532 perpendicular to the main portion 531.

The main portion 531 of the third flat radiating element 53 is located perpendicular to the Y-axis and apart from the coaxial cable 25. A major axis of the main portion 531 is substantially in parallel to the major axis of the second radiating element 22. The major axis of the main portion 531 may be collinear with the major axis of the second radiating element 22.

The rectangular tab portion 532 connects the end (and/or its vicinity) of the outer conductor 252 to an upper end of the main portion 531 of the third radiating element 53.

When the first and the second flat radiating elements 21 and 22 have the above mentioned measurements regarding the antenna 20 of FIG. 2, a height h5 and a width w7 of the third flat radiating element 53 are equal to about 0.2–0.25 times and about 0.15–0.25 times as large as the wavelength λL, for example. Moreover, a width w8 and a length w9 of the tab portion 532 are equal to values between a hundredths part and a twentieth part of the wavelength λL. Generally, the width w8 is equal to a diameter of the outer conductor 252.

Figure 6:
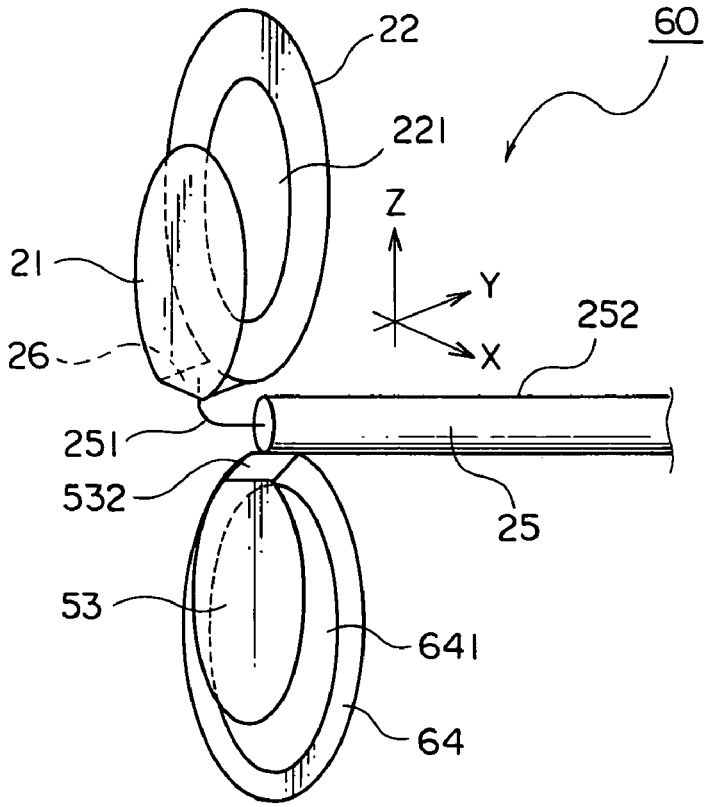
FIG. 6 is an oblique perspective view of an antenna according to a fourth embodiment of this invention.

Referring to FIG. 6, the description will be made about an antenna according to a forth embodiment of this invention.

In FIG. 6, the antenna 60 is similar to the antenna 50 of FIG. 5 except that the coaxial cable 25 is located perpendicular to the Z-axis and that a fourth flat radiating element 64 opposite to the third flat radiating element 53 is connected to the outer conductor 252.

The combination of the third and the fourth flat radiating elements 53 and 64 is similar to the combination of the first and the second flat radiating elements 21 and 22. However, the third and the fourth flat radiating elements 53 and 64 are inverted in relation to the Z-axis. Particularly, the third and the fourth flat radiating elements 53 and 64 are located perpendicular to the Y-axis so that their major axes are in parallel to the Z-axis. The rectangular tab portion 532 is connected to an upper end of the fourth flat radiating element 64 and to the outer conductor 252.

In FIG. 6, it seems that measurements of the third and the fourth flat radiating elements 53 and 64 are different from those of the first and the second flat radiating element 21 and 22. However, the third and the fourth flat radiating elements 53 and 64 may have the same measurements as those of the first and the second radiating elements 21 and 22.

The coaxial cable 25 may be in parallel to the Y-axis. In such a case, the coaxial cable 25 may be bent to reduce the thickness of the antenna 60. When the coaxial cable 25 is located parallel to an X-axis, a thickness of the antenna 60 has a minimum value. The central conductor 251 is bent to be connected and fixed to the conductive piece 27. The outer conductor 252 is fixed to a part of the rectangular tab portion 532.

Figure 7:
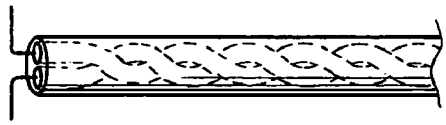
FIG. 7 is an oblique perspective view of a balanced pair cable usable for the antenna of FIG. 6.
Figure 8:
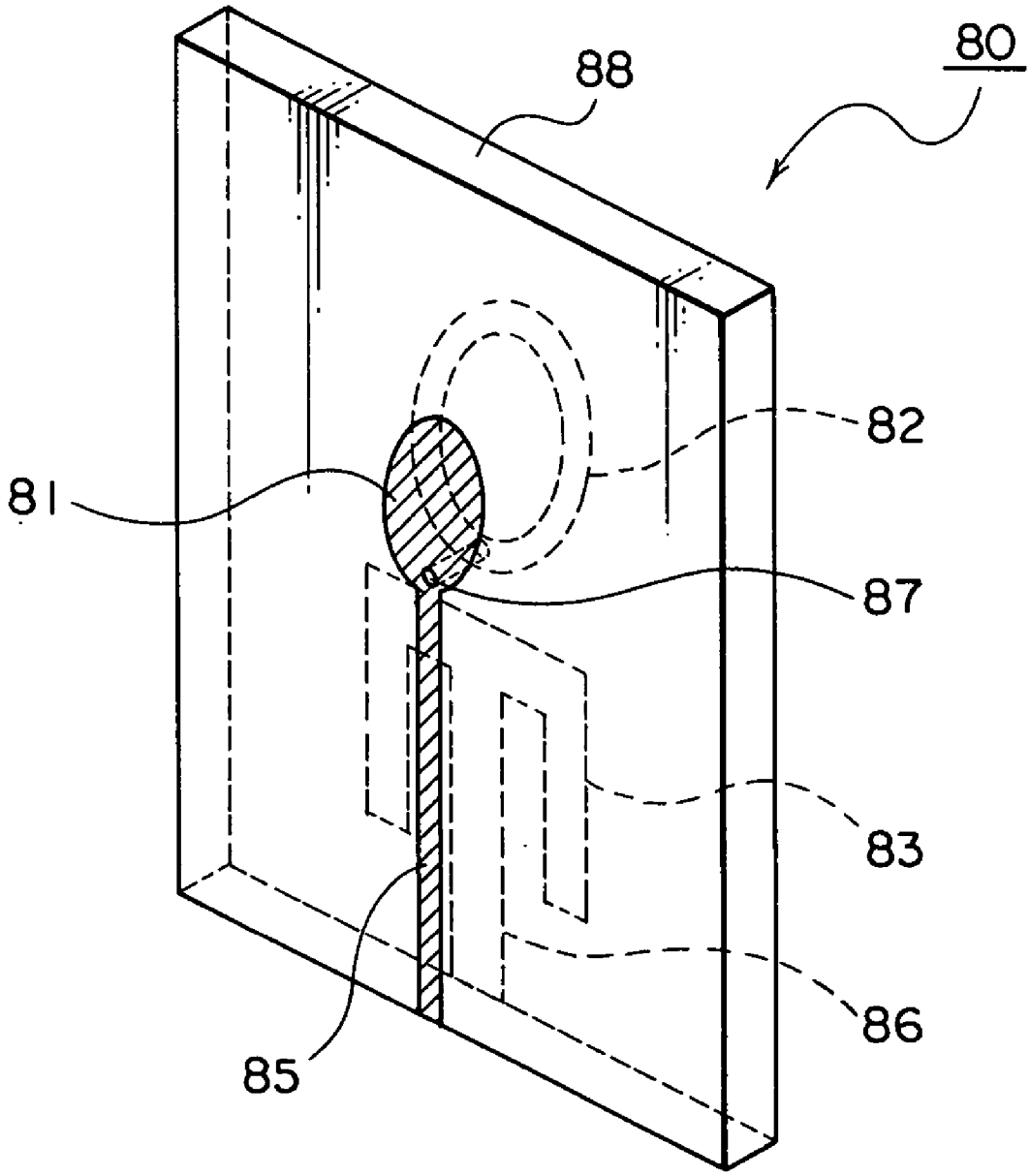
FIG. 8 is an oblique perspective view of an antenna according to a fifth embodiment of this invention.
Figure 9C:
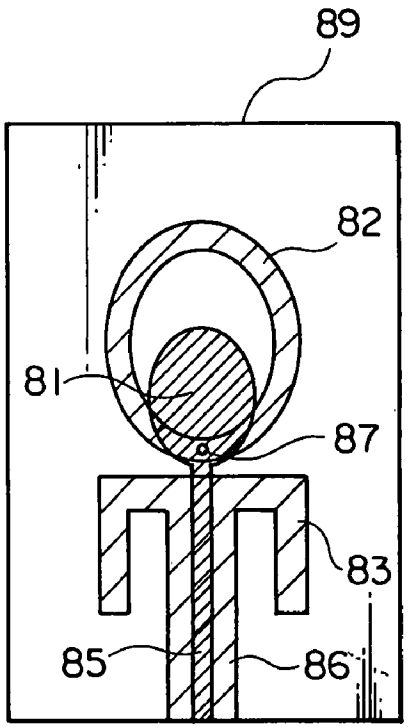
FIG. 9C is a perspective view of the antenna of FIG. 8.
Figure 9B:
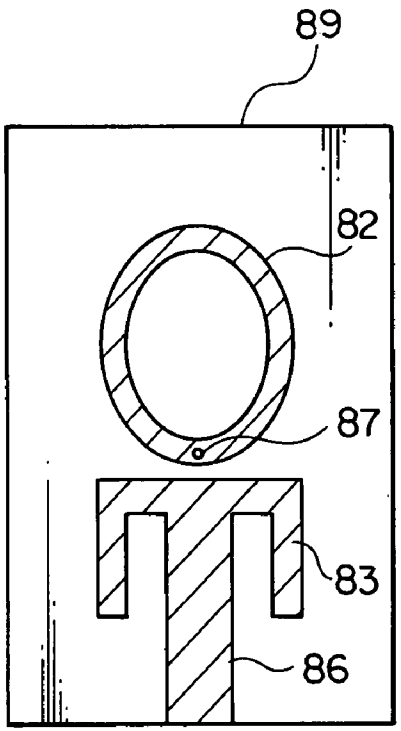
FIG. 9B is a rear view of the antenna of FIG. 8.
Figure 9A:
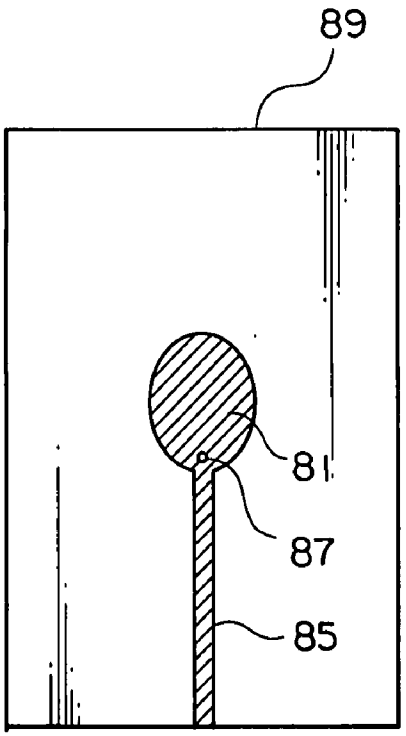
FIG. 9A is a front view of the antenna of FIG. 8.

For the antenna 60, a balanced pair cable as shown in FIG. 7 may be used instead of the coaxial cable 25. The balanced pair cable has a pair of wires one of which is electrically connected to the first and the second flat radiating elements 21 and 22 and the other of which is electrically connected to the third and the fourth flat radiating elements 53 and 64. In this case, the major axis of the third flat radiating element 53 may be collinear with that of the first flat radiating element 21 and/or the major axis of the fourth radiating element 64 may be collinear with that of the second flat radiating element 22. It's often the case that the balanced pair cable improves impedance matching in comparison with the coaxial cable 25.

Referring to FIGS. 8 and 9A–9C, the description will be made about an antenna according to a fifth embodiment of this invention.

The antenna 80 of FIGS. 8 and 9A–9C is equivalent to the antenna 20 of FIG. 2 in theory. The antenna 80 includes a first flat radiating element 81, a second flat radiating element 82, a third flat radiating element 83, a microstrip line 85, a ground conductor 86, a through hole 87, and an dielectric substrate 88.

The dielectric substrate 88 has first and second surface opposite to each other.

The first flat radiating element 81 has an outer shape of an ellipse or oval and a major axis. The first flat radiating element 81 is formed on the first surface of the dielectric substrate 88.

The second flat radiating element 82 has an elongated annular shape with outer and inner shapes similar to the outer shape of the first flat radiating element 81. The second flat radiating element 82 is formed on the second surface of the dielectric substrate 88 to be opposite to the first radiating element 81. The second flat radiating element 82 has a major axis parallel to that of the first flat radiating element 81. Furthermore, the second flat radiating element 82 has a lower end portion level with that of the first flat radiating element 81. The lower end portion of the second flat radiating element 82 is electrically connected to that of the first radiating element 81 via the through hole 87 formed in the dielectric substrate 88.

The third flat radiating element 83 has a U or horseshoe shape. The third flat radiating element 83 is formed on the second surface of the dielectric substrate 88 at a distance from the second flat radiating element 82. The third flat radiating element 83 has a central axis collinear with the major axis of the second flat radiating element 82 and end portions directed in an opposite side of the second flat radiating element 82.

The microstrip line 85 has a strip shape and a central axis collinear with the major axis of the first flat radiating element 81. The microstrip line 85 is formed on the first surface of the dielectric substrate 88 to be continuous with the first flat radiating element 81. The microstrip line 85 serves as a first feeding line.

The ground conductor 86 has a wide strip shape and a central axis collinear with the major axis of the second flat radiating element 82. It is desirable that the ground conductor 86 has a width of 2–2.5 times as wide as that of the microstrip line 85. Alternatively, the microstrip line 85 may have a width of 2–2.5 times as wide as that of the ground conductor 86. The ground conductor 86 is formed on the second surface of the dielectric substrate 88 to be continuous with the third flat radiating element 83. The ground conductor 86 serves as a second feeding line. That is, the ground conductor 86 forms microstrip transmission lines together with the microstrip line 85. Accordingly, it is desirable that the central axis of the ground conductor 86 coincides with that of the microstrip line 85 regarding a thickness direction of the dielectric substrate.

When the dielectric substrate 88 is small in thickness, there is a case where capacitive coupling is caused between the first flat radiating element 81 and the second flat radiating element 82.

The antenna 80 may be made of, for example, a printed circuit board having a dielectric substrate and copper foils deposited on both sides of the dielectric substrate. As the dielectric substrate for the printed circuit board, a Teflon (a registered trademark) substrate, a denatured BT (bis-maleimide triazine) resin substrate, a PPE (polyphenylether) substrate, a glassy epoxy substrate or the like may be used. The insulating substrate has a thickness of 0.4–3.2 mm, for instance. In addition, an FPC (flexible printed circuit) may be used to manufacture the antenna 80 in place of the printed circuit board. In this case, an dielectric substrate of the FPC may have a thickness smaller than 0.2 mm.

The printed circuit board is treated to pattern the copper foils. In other words, etching for the copper foils make the first through the third flat radiating elements 81–83, the microstrip line 85 and the ground conductor 86. A hole for the through hole 87 is formed in the printed circuit board. An inner surface defining the hole is covered with a conductor to form the through hole 87. The remaining copper foils are coated with solder or plated with nickel to avoid corrosion. The coating of the solder or the plating of the nickel may be used to cover the inner surface of the hole for the through hole 87 with the conductor.

The measurements of the first through the third flat radiating elements 81–83 are almost equal to those of FIG. 2. However, existence the dielectric substrate 88 allows miniaturizing the first through the third flat radiating elements 81–83 as the antenna 80 has the wideband characteristic. Accordingly, the antenna 80 is suitable for a smaller computer or a smaller audio-visual apparatus. In addition, the antenna 80 has a stable characteristic because relative positions of the first to the third flat radiating elements 81–83 are fixed by the dielectric substrate.

Figure 10:
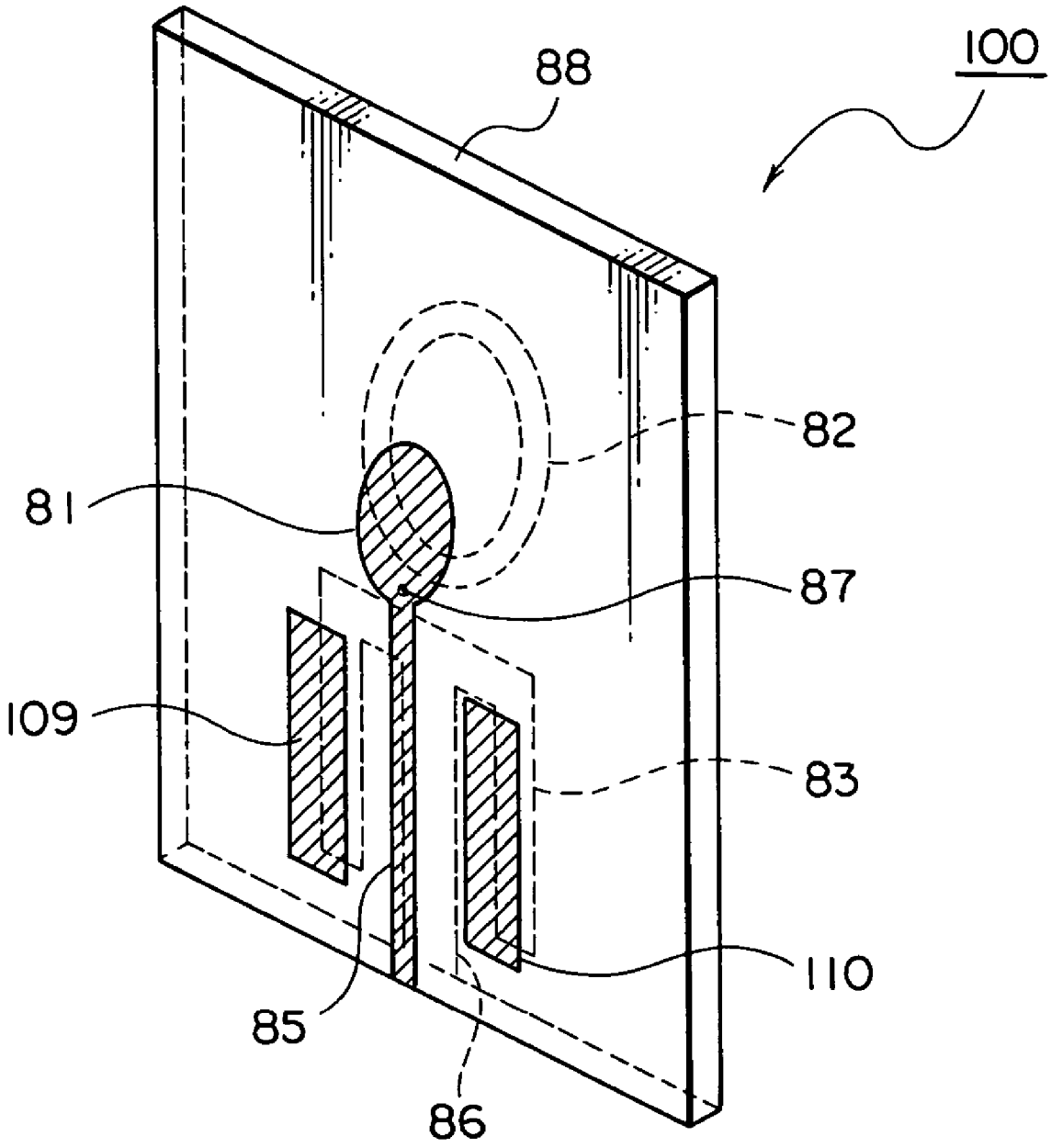
FIG. 10 is an oblique perspective view of an antenna according to a sixth embodiment of this invention.
Figure 11A:
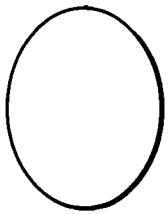
FIGS. 11A–11K show examples of shapes for a first radiating element usable for this invention.
Figure 11B:
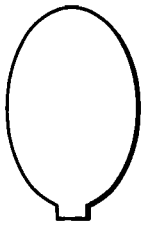
Figure 11C:
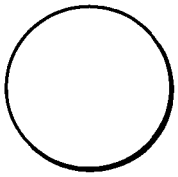
Figure 11D:
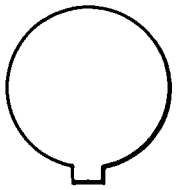
Figure 11E:
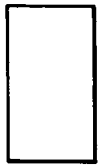
Figure 11F:
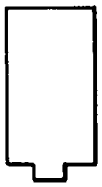
Figure 11G:
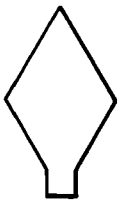
Figure 11H:
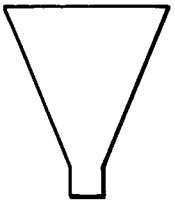
Figure 11I:
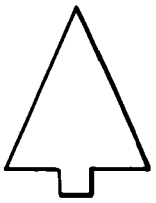
Figure 11J:
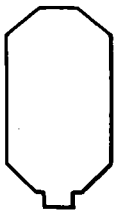
Figure 11K:
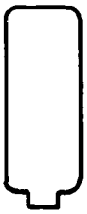
Figure 12A:
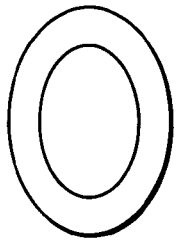
FIGS. 12A–12J show examples of shapes for a second radiating element usable for this invention.
Figure 12B:
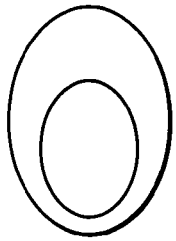
Figure 12C:
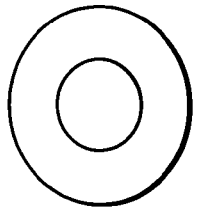
Figure 12D:
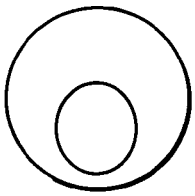
Figure 12E:
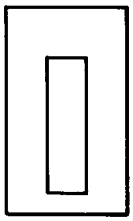
Figure 12F:
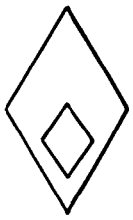
Figure 12G:
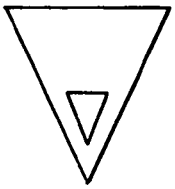
Figure 12H:
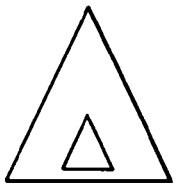
Figure 12I:
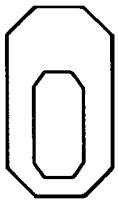
Figure 12J:
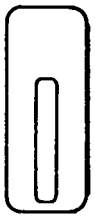
Figure 13A:
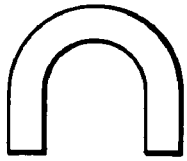
FIGS. 13A–13I show examples of shapes for a third radiating element usable for this invention.
Figure 13B:
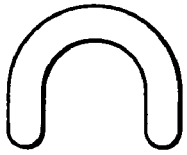
Figure 13C:
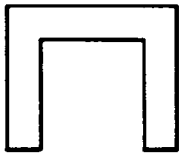
Figure 13D:
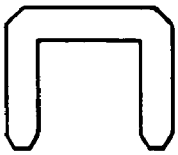
Figure 13E:
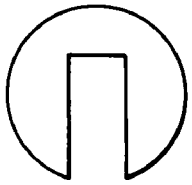
Figure 13F:
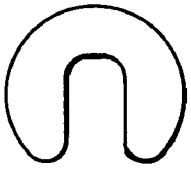
Figure 13G:
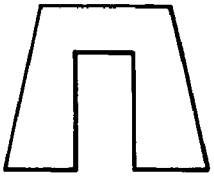
Figure 13H:
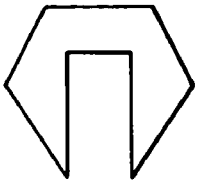
Figure 13I:
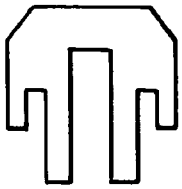

Referring to FIG. 10, the description will be made about an antenna according to a sixth embodiment of this invention. The antenna 100 is similar to the antenna 80 of FIG. 8 except a pair of parasitic elements 109 and 110.

The parasitic elements 109 and 110 are formed on the first surface of the dielectric substrate 88 to be opposite to parts of the third flat radiating element 83. When the antenna 100 is made of the printed circuit board, the parasitic elements 109 and 110 may be formed by etching for the first through the third flat radiating elements 81–83, the microstrip line 85 and the ground conductor 86. The parasitic elements 109 an 110 serve to widen a frequency band of the antenna 80. The parasitic elements 109 and 110 may have a length of 0.2–0.25 times or about 0.5 times as large as the wavelength $\lambda L$.

The number of parasitic elements is determined according to the purpose and/or shapes of the third flat radiating element 83. For example, the number of the parasitic elements is from 1 to 4. The parasitic elements may be unsymmetrical with respect to the central axis of the microstrip line 85.

While this invention has thus far been described in conjunction with the preferred embodiment thereof, it will readily be possible for those skilled in the art to put this invention into practice in various other manners.

For example, the shape of the first flat radiating element 21 (41, or 81) may be selected from various shapes as illustrated in FIGS. 11A–11K. Similarly, the shape of the second flat radiating element 22 (42, or 82) may be selected from various shapes as illustrated in FIGS. 12A–12J. Here, the outer shape and the inner shape of the second flat radiating element 22 (42, or 82) may be quiet different. Furthermore, the shape of the third flat radiating element 23 (43, or 83) may be selected from various shapes as illustrated in FIGS. 13A–13J. Regarding the third and the forth flat radiating element 53 and 54, they are similar to the first and the second flat radiating elements 21 and 22. Still furthermore, the shape of the parasitic element may be selected from carious shapes as illustrated in FIGS. 11A–11K. In addition, various combinations of shapes may be used for the first to the third (or fourth) flat radiating elements.

At any rate, the shapes of the flat radiating elements may be designed according to desired characteristics and the space in which the antenna is housed.

What is claimed is:

1. An antenna comprising:

a first flat radiating element substantially defining a first plane;

a second flat radiating element substantially defining a second plane substantially parallel to but spaced apart from the first plane;

a third flat radiating element substantially defining a third plane, wherein said third plane is substantially coplanar with or parallel to said first or second plane;

a first feeding line electrically connected to both said first flat radiating element and said second flat radiating element; and a second feeding line electrically connected to said third flat radiating element, wherein said second flat radiating element defines an opening fully enclosed within said second flat radiating element.

2. An antenna claimed in claim 1, wherein:

said second flat radiating element has a ring-like shape.

3. An antenna claimed in claim 2, wherein:

said first flat radiating element has a first outer shape while the ring-like shape of said second flat radiating element has a second outer shape similar to the first outer shape.

4. An antenna claimed in claim 3, wherein:

the ring-like shape of said second flat radiating element has a inner shape similar to the first outer shape.

5. An antenna claimed in claim 3, wherein:

the first outer shape is a circle, an ellipse, an oval, or a polygon.

6. An antenna claimed in claim 3, wherein:

said third flat radiating element has an inverted U shape, an inverted horseshoe shape, a fork shape, a rake shape, a circular shape, an elliptic shape, an oval shape, or a polygonal shape.

7. An antenna claimed in claim 3, wherein:

said first flat radiating element, said second flat radiating element, and said third flat radiating element comprise conductive plates; and wherein:

said first feeding line and said second feeding line provided by a coaxial cable.

8. An antenna claimed in claim 3, further comprising a fourth flat radiating element parallel to but not coplanar with said third flat radiating element, wherein:

said second feeding line is electrically connected to both said third flat radiating element and said fourth flat radiating element.

9. An antenna claimed in claim 8, wherein:

said third flat radiating element has a third outer shape similar to the first outer shape, and wherein:

said fourth flat radiating element is similar to said second flat radiating element in shape.

10. An antenna claimed in claim 8, wherein:

said first flat radiating element, said second flat radiating element, said third flat radiating element and said fourth flat radiating element comprise conductive plates; and wherein:

said first feeding line and said second feeding line provided by a balanced two wire type cable.

11. An antenna claimed in claim 3, further comprising a dielectric substrate having first and second surfaces opposite to each other, wherein:

said first flat radiating element comprises a first conductive film formed on the first surface of said dielectric substrate;

said second flat radiating element and said third flat radiating element comprising a second conductive film and a third conductive film, respectively, formed on the second surface of said dielectric substrate, said second conductive film being electrically connected to said first conductive film via a through hole formed in said dielectric substrate;

said first feeding line comprising a first microstrip line formed on the first surface of said dielectric substrate; and said second feeding line comprising a second microstrip line formed on the second surface of said dielectric substrate.

12. An antenna claimed in claim 11, further comprising a parasitic flat element formed on the first surface of said dielectric substrate to be opposite to said third conductive film.

13. An antenna claimed in claim 1, further comprising:

a conducting element which connects said first flat radiating element and said second flat radiating element.

* * * * *